US005386209A

United States Patent [19]

Thomas

[11] Patent Number: 5,386,209

[45] Date of Patent: Jan. 31, 1995

[54] CLUSTER ALARM MONITORING SYSTEM

[76] Inventor: Winston M. H. Thomas, 3709 Woodrail Dr., Plano, Tex. 75074

[21] Appl. No.: 985,164

[22] Filed: Nov. 30, 1992

Related U.S. Application Data

[63] Continuation-in-part of Ser. No. 827,086, Jan. 21, 1992, abandoned.

[51] Int. Cl.[6] ..... G08B 1/08

[52] U.S. Cl. ..... 340/539; 340/531; 455/38.2

[58] Field of Search ..... 340/539, 537; 455/38.1, 455/38.2, 38.4, 67.1

[56] References Cited

U.S. PATENT DOCUMENTS

| | | | |
|---|---|---|---|
| 3,689,888 | 9/1972 | Wootton | 340/539 |
| 3,909,826 | 9/1975 | Schildmeier et al. | 340/539 |
| 4,358,756 | 11/1982 | Morel et al. | 340/539 |
| 4,581,605 | 4/1986 | Vogt | 340/525 |
| 4,622,538 | 11/1986 | Whynacht et al. | 340/506 |
| 4,672,365 | 6/1987 | Gehman et al. | 340/539 |
| 4,812,820 | 3/1989 | Chatwin | 340/518 |
| 4,859,990 | 8/1989 | Isaacman | 340/539 |

*Primary Examiner*—Donnie L. Crosland
*Attorney, Agent, or Firm*—Dennis T. Griggs

[57] ABSTRACT

An alarm unit is adapted to cooperate by radio transmission with a plurality of other such units arranged in a cluster. Each alarm unit includes a radio transmitter and receiver; a modulator for the transmitter and a demodulator for the receiver; an identifying pre-settable switch for identifying the particular alarm unit in the cluster; multiple alarm transducers for identifying a particular one of a plurality of types of alarm; an encoder coupled to the alarm transducers for controlling the modulator, whereby the transmitter can transmit an encoded transmission identifying the particular alarm unit and the particular alarm type; a decoder for decoding the identification of another of the units in the cluster which is transmitting and the type of its present alarm; and a display for displaying the other unit's identification and the alarm type.

10 Claims, 3 Drawing Sheets

CLUSTER ALARM MONITORING SYSTEM

CROSS-REFERENCE TO RELATED APPLICATION

This application is a continuation-in-part of U.S. application Ser. No. 07/827,086, filed Jan. 21, 1992, now abandoned.

FIELD OF THE INVENTION

The present invention relates generally to electronic security systems, and in particular to an alarm unit adapated to co-operate by radio transmission with a plurality of other such units arranged in a cluster and forming an alarm system.

BACKGROUND OF THE INVENTION

Conventional electronic security systems provide detection alarm enunciation and reporting. Such systems include an alarm bell with a control unit reporting to the local police authorities via telephone lines and radio transmission, and an alarm bell and control unit reporting to a commercial or private central station via telephone lines or radio transmission. These conventional alarm security systems are limited by not having the ability to respond to alarm conditions efficiently and effectively. When an alarm condition exists, the response time of a conventional system is determined by the work load of the police and security departments, the priorities of the police and security departments, highway conditions leading to the protected property, communication difficulties to inform the patrol personnel, and the efficiency, security and reliability of the communication lines connecting the alarm unit to the central station. These factors substantially influence the reliability and integrity of conventional electronic security systems.

DESCRIPTION OF THE PRIOR ART

U.S. Pat. No. 4,859,990 to Isaacman describes a transceiver security system having a receiver unit and a transmitter unit. The transmitter unit has a push button which, when depressed, causes the transmitter to generate a radio frequency signal which is encoded with a security code. The receiver unit picks up the transmitted radio frequency signal by an antenna and if the security code transmitted by the transmitter unit matches the security code stored in the receiver unit, the receiver unit responds by generating a command signal which may be used to close a relay, for example, the contacts of which can be wired to a garage door lifting/closing device, a gate lifting/closing device or to an electronic lock.

U.S. Pat. No. 3,909,826 to Schildmeier et al. describes a group of alarm units, each of which includes a radio transmitter for transmitting a coded signal unique to that unit when an emergency condition is detected. Each unit also includes a radio receiver and decoder for receiving coded signals from any other alarm unit in the system and for determining which other alarm unit is transmitting. The code of the other transmitting unit is displayed on an LED panel of each receiving unit and an audio alarm is sounded.

Similarly, U.S. Pat. No. 4,812,820 to Chatwin describes for use in a neighborhood watch system a transceiver internally coded with an address-number for identification within the system and is adapted to receive input from sensors detecting alarm conditions.

The unit is switchable from an idle condition wherein it transmits digital data relevant to its address-number status but does not recognize input signals from a sensor, to a primed condition wherein it transmits digital data relevant to its address-number and status information indicating an alarm condition. The unit is able to receive digital data from other similar units sequentially and display information relevant to the identity and status thereof.

OBJECTS OF THE INVENTION

An object of the invention is to provide an improved alarm unit for use in a neighborhood watch security system.

Another object of the invention is to provide an alarm unit which is able to discriminate between different types of alarm at its premises.

A further object of the invention is to provide an alarm unit having a memory of previous alarms.

Again another object of the invention is to provide an alarm unit having a display able to display a plurality of previous alarm conditions.

SUMMARY OF THE INVENTION

The alarm units of the present invention are interlinked in a cluster and operate independently of each other in detecting and reacting to an alarm local to itself. Each alarm unit contains a transmitter and a receiver. In the event of an alarm, the unit detecting the alarm transmits an indication of the alarm and all the other units in the cluster receive the transmission. In the neighborhood watch security system, a plurality of such units communicate with each other and in turn transmit the digital data to all other units of the system simultaneously, either by hard wiring thereto, radio link or other transmission medium. An alarm condition detected by one unit is recognized at all units of the system. Remote switching of a unit from idle to primed by any of the other units is disclosed.

An alarm unit according to the present invention is adapted to cooperate by radio transmission with a plurality of other such units arranged in a cluster, each said unit including:

- a radio transmitter and receiver;
- a modulator for the transmitter and a demodulator for the receiver;
- an identifying pre-settable device for identifying the particular device in the cluster;
- means for connection to a plurality of alarm transducers for identifying a particular one of a plurality of types of alarm;
- an encoder for controlling the modulator, whereby the transmitter can transmit encoded transmission identifying the particular device and the particular alarm type;
- a decoder for decoding the identification of another of the units in the cluster which is transmitting and the type of its present alarm; and
- a display for displaying the other unit's identification and the alarm type.

Operational features and advantages of the invention will appear from the following description of a preferred embodiment of the alarm system.

BRIEF DESCRIPTION OF THE DRAWINGS

To help understanding of the invention, a preferred embodiment of it will now be described by way of example and with reference to the accompanying drawings, in which.

DETAILED DESCRIPTION OF THE PREFERRED EMBODIMENT

Figure 1:
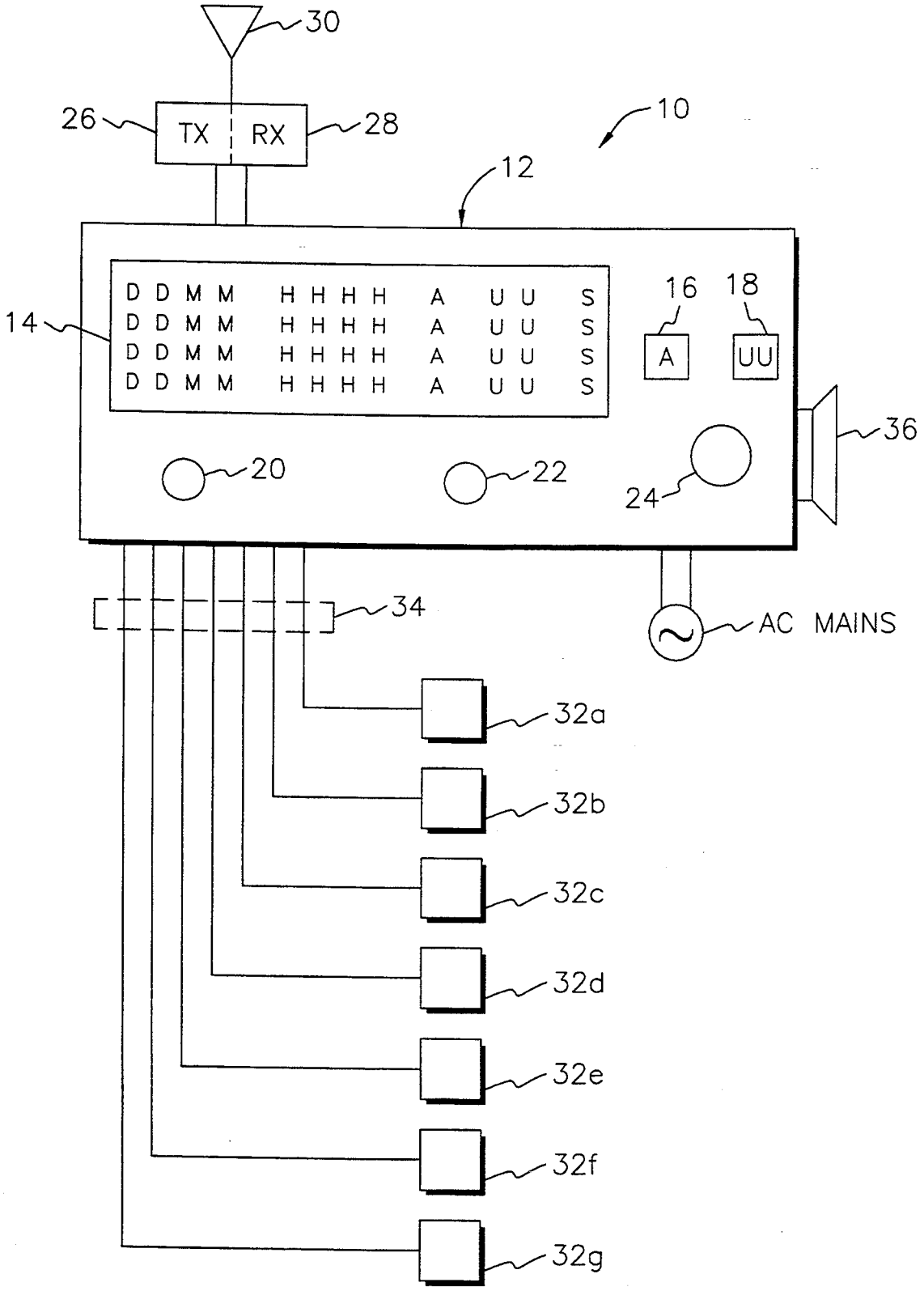
FIG. 1 is a diagrammatic view of an alarm unit of the invention.

Referring first to FIG. 1, the preferred alarm unit 10 of the present invention has a case 12 on which are mounted a four line LCD display 14, a single digit LED display 16, a double digit LED display 18, a reset button 20, a test button 22, and a panic button 24. Internally, the case 12 carries a printed circuit board incorporating circuitry embodying a transmitting circuit 26 and a receiving circuit 28 shown in block diagram form in FIGS. 2 and 3, respectively. The actual implementation of the circuitry is believed to be within the capabilities of one skilled in the art and will not be described.

The radio transmitter 26 and receiver 28 are connected to a common antenna 30. Also coupled to the alarm unit 10 are a series of alarm transducers or sensors 32A, 32B, 32C, 32D, 32E, 32F and 32G. These may be of various forms according to the use of the alarm unit. For instance, they may comprise window and door opening detection switches, a fire detection switch, a motion detector switch and the like. Generally, the alarm sensor switches 32A–32G make a conductive path to ground in the event of an alarm condition of the type they are intended to detect. The sensors are connected to the unit 10 by signal cables 34. The case 12 also supports a loudspeaker 36.

In use, the sensors sense an alarm condition/event, which initiates the control circuitry and the transmitter to transmit a coded message identifying the particular alarm unit and the particular alarm condition/event at the unit. Other alarm units in the cluster as well as the local alarm unit 10 receive the transmission and decode it. The LED display 16 shows a single alphanumeric character identifying the alarm type, i.e., the alarming sensor, and the two digit display 18 identifies the location of the alarming unit. An audio alarm is sounded through the loudspeaker 36. The LCD display 14 shows not only the current alarm, but also three previous alarms, including their time and date, the units and alarm types of each. Additionally, the LCD display 14 shows a single status digit S indicating whether the alarm is still current or has been cancelled.

Figure 2:
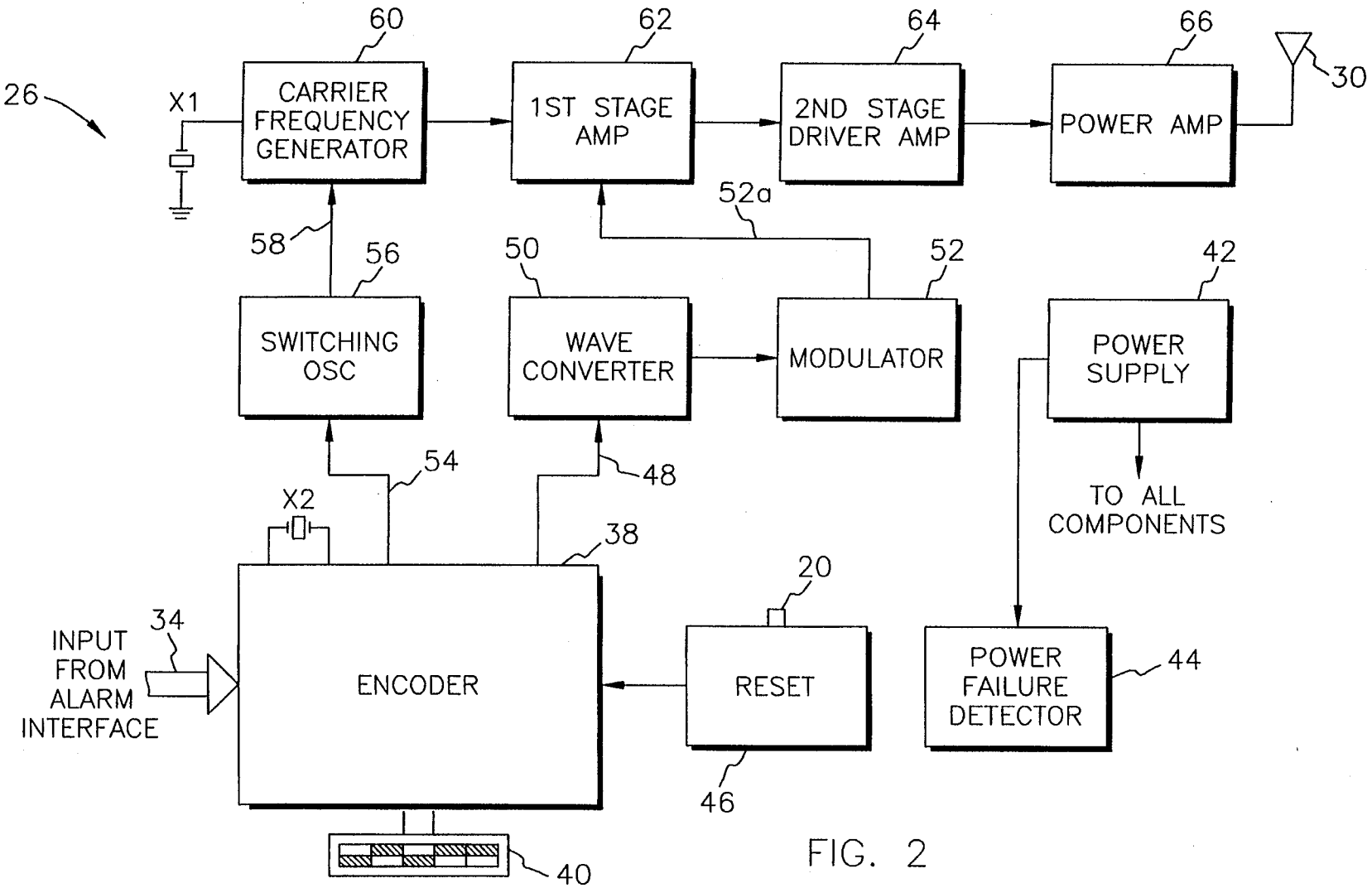
FIG. 2 is a block diagram of a transmitting section of the circuitry of the unit; and, FIG. 3 is a block diagram of a receiving section of the circuitry of the unit.

Referring now to FIG. 2, the transmitting portion 26 of the circuitry of the alarm unit 10 has an encoder 38 to which are connected the alarm sensors 32A, 32B, 32C, 32D, 32E, 32F, and 32G. A five digit jumper switch 40 is also connected to the encoder 38 for uniquely identifying between 1 and 32 alarm units in a cluster of up to 32 units. A power supply 42, in the form of an AC mains transformer and rectifier together with an integral battery back-up, provides D.C. essential operating voltage to all the components and has associated with it a power failure detector 44. A reset circuit 46 is connected to the encoder 38 for resetting the encoder in the event of power failure.

An output 48 of the encoder is connected to a wave converter 50 for converting a code from the encoder 38 into a wave form. The wave converter 50 in turn is connected to a modulator 52. A further output 54 from the encoder 38 is connected to a switching oscillator 56. The switching oscillator 56 has an output 58 connected to a carrier frequency generator 60. The output from the latter is connected to a cascaded first stage amplifier 62 and a second stage amplifier 64, to which the modulator 52 is also connected by an output 52A. A power amplifier 66 is connected between the second stage amplifier 64 and the antenna 30.

Figure 3:
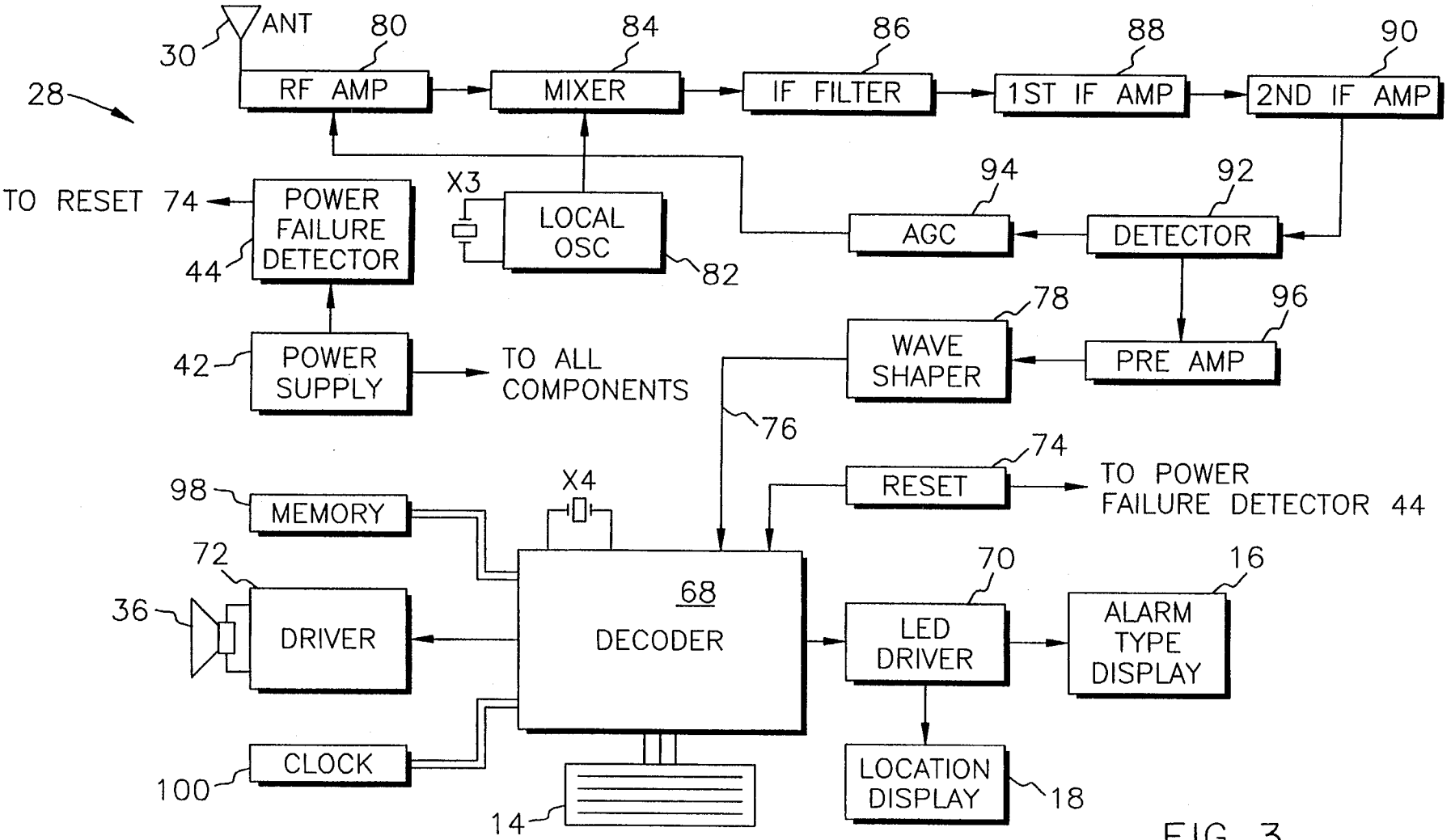

Referring now to FIG. 3, the receiving section 28 of the circuitry of the alarm unit 10 has a decoder 68 to which are connected the LCD display 14, a driver 70 for the LED displays 16, 18 and a driver 72 for the loudspeaker 36. A reset switch 74, analogous to the reset switch 46, is also coupled to the power failure detector 44 and to the decoder 68. To an input 76 of the decoder 68 a wave shaper 78 of the receiver 28 is connected. The receiver 28 also includes a radio frequency amplifier 80 connected to the antenna 30, a local osicillator 82, a mixer 84, an intermediate frequency filter 86, cascaded first and second intermediate frequency amplifiers 88, 90, a detector 92 , an automatic gain control 94 and a pre-amplifier 96. These blocks of the radio receiver section 28 are conventional and as such their construction will be within the capabilities of one skilled in the art and they will not be described further.

Upon the occurrence of an alarm condition/event, and in accordance with whichever of the alarm sensors 32A, 32B, 32C, 32D, 32E, 32F, or 32G detects an alarm and the identification code set in the jumper switch 40, the encoder 38 causes the transmitter 26 to transmit a coded transmission identifying the unit transmitting and its sensor which is alarming. The receiver 28 in the same alarm unit 10 and the other units in the linked cluster receives the transmission, which is decoded by the decoder 68. The latter causes the LED displays 16, 18 to display the number of the alarm type and the number of the transmitting unit. The loudspeaker 36 is also activated for a set length of time unless suppressed.

The LCD display 14 is up-dated to display details of the most recent alarm, including not only the alarm type and the alarming unit, but also the time and date of the alarm and the fact that the alarm is current. When the alarm has been answered and the unit reset via the reset button 20, the status digit S changes on the LCD display 14, informing other users that the alarm has been answered. Four alarms can be displayed. For this a memory 98 is connected to the decoder 68. For date and time display on the LCD display, a clock 100 is connected to the decoder 68.

It should be noted that the panic button 24 is a special type of alarm sensor, designed to be set off manually by the operator, to alert other alarm units of an alarm which would not otherwise be detected.

In the event of power failure or low battery power, the loudspeaker 36 is activated to alert the operator for remedial action to be taken.

The test button 22 enables the alarm unit 10 to be tested and causes the encoder 38 to transmit a test transmission. The reset button 20 causes the encoder 38 to be reset and discontinue transmission of the present alarm transmission. Used in combination, these two buttons enable the clock 100 to be set to the present time and date.

The encoder 38 and decoder 68 can be implemented in micro-processor form. This implementation is within the capabilities of one skilled in the art and will not be described.

I claim:

1. An alarm unit adapted to co-operate by radio transmission with a plurality of other such units arranged in a cluster, said alarm unit comprising:

a radio transmitter and receiver;

a modulator coupled to the transmitter and a demodulator coupled to the receiver;

an identifying pre-settable switch for identifying a particular alarm unit in the cluster;

means for connection to a plurality of alarm sensors for identifying a particular one of a plurality of types of alarms;

a clock for generating a signal from which real time and date may be derived;

an encoder coupled to the clock, the pre-settable switch and the alarm sensor connection means for controlling the modulator, whereby the transmitter can transmit an encoded transmission identifying a particular alarm unit, the type of an alarm event and the real time and date of occurrence of an alarm event;

a decoder for decoding the identification of another of the units in the cluster which is transmitting, the type of a present alarm event and the real time and date of occurrence of a present alarm event; and a display for displaying the other unit's identification, the type of alarm event and the time and date of occurrence of the alarm event.

2. An alarm unit according to claim 1, including a memory for storing details of at least some previous alarms.

3. An alarm unit according to claim 2, wherein the display is adapted to display simultaneously details of the present alarm and previous alarms, if any.

4. An alarm unit according to claim 1, wherein the decoder is adapted to control the display to display the time and date of the alarm occurring.

5. An alarm unit according to claim 3, wherein the decoder is adpated to control the display to display the time and date of occurrence of the present alarm and the alarm details stored in said memory.

6. An alarm unit according to claim 2, including a further display for showing the details of the present alarm.

7. An alarm unit according to claim 1, including a panic button switch on the unit for causing the encoder to transmit a panic transmission.

8. An alarm unit according to claim 1, including an audio alert, controlled by the decoder, for sounding an alert in the event of a present alarm.

9. An alarm unit according to claim 1, including means for resetting the encoder to show that an alarm has been answered, the display including a status digit for indicating whether the present alarm event is still current or has been answered.

10. An alarm unit according to claim 1, in combination with a plurality of alarm sensors, each adapted to identify a particular one of a plurality of types of alarm.

* * * * *